United States Patent [19]

Farr

[11] Patent Number: 4,509,433

[45] Date of Patent: Apr. 9, 1985

[54] COLLAPSIBLE EXPANSIBLE HANDLING FACILITY FOR UNITIZED AND UNIT LOADS

[76] Inventor: Kenneth Farr, 3, Victoria La. Colcar, Huddersfield, Yorks, England

[21] Appl. No.: 442,196

[22] PCT Filed: Mar. 9, 1982

[86] PCT No.: PCT/GB82/00081

§ 371 Date: Nov. 9, 1982

§ 102(e) Date: Nov. 9, 1982

[87] PCT Pub. No.: WO82/03057

PCT Pub. Date: Sep. 16, 1982

[30] Foreign Application Priority Data

Mar. 10, 1981 [GB] United Kingdom ..... 8107561

[51] Int. Cl.[3] ..... B65D 19/40

[52] U.S. Cl. ..... 108/52.1; 108/51.1; 108/51.3; 206/599

[58] Field of Search ..... 108/52.1, 51.1, 51.3, 108/55.1, 55.5, 56.1, 56.3, 57.1, 901; 248/346; 206/599, 600, 386

[56] References Cited

U.S. PATENT DOCUMENTS

| | | | |
|---|---|---|---|
| Re. 29,192 | 4/1977 | Anderson et al. | 108/51.3 |
| 2,503,240 | 4/1950 | Cahners | 108/51.3 |
| 2,702,682 | 2/1955 | Newsom | 108/51.3 |
| 3,167,038 | 1/1965 | Brown | 108/51.3 |
| 3,199,764 | 8/1965 | Olwer et al. | 108/51.3 X |
| 3,380,404 | 4/1968 | Shell | 108/52.1 |
| 3,470,832 | 10/1969 | Heffernan | 108/56.3 X |
| 3,567,068 | 3/1971 | Carfizzi | 108/56.3 X |
| 3,881,429 | 5/1975 | Seymore | 108/56.3 X |
| 3,940,101 | 2/1976 | Heidelbach | 108/56.3 X |
| 4,059,057 | 11/1977 | Carnwath | 108/52.1 X |
| 4,109,587 | 8/1978 | Jansen, Jr. | 108/51.3 X |
| 4,116,344 | 9/1978 | Ziemba | 248/346 X |

FOREIGN PATENT DOCUMENTS

| | | | |
|---|---|---|---|
| 1492621 | 8/1967 | France | 108/51.3 |
| 696214 | 1/1953 | United Kingdom | 108/51.1 |
| 1186695 | 4/1970 | United Kingdom | 108/51.1 |

*Primary Examiner*—William E. Lyddane
*Assistant Examiner*—Peter R. Brown
*Attorney, Agent, or Firm*—Emory L. Groff, Jr.

[57] ABSTRACT

A pallet carrying industrial loads includes on the base thereof, two parallel longitudinally extending sleeve members of which the sides are pleated whereby the sleeve may collapse in a vertical direction with the folded sides supporting the weight of the pallet. The sleeve incorporates an initial opening for entry of a fork lift whereby as the fork is moved into the sleeve the pleated sides allow progressive expansion. On removal of the forks the sleeve progressively collapses to provide reduced storage height and lessening the transport costs. The sleeve and pallet base may be constructed from fibreboard materials.

11 Claims, 41 Drawing Figures

Figure 3:
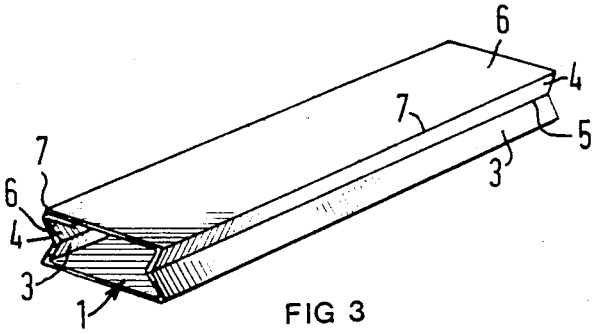

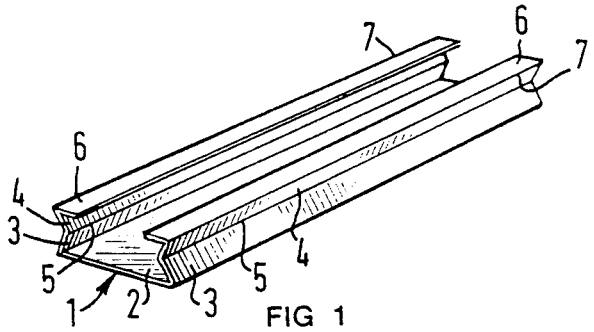
FIG 1
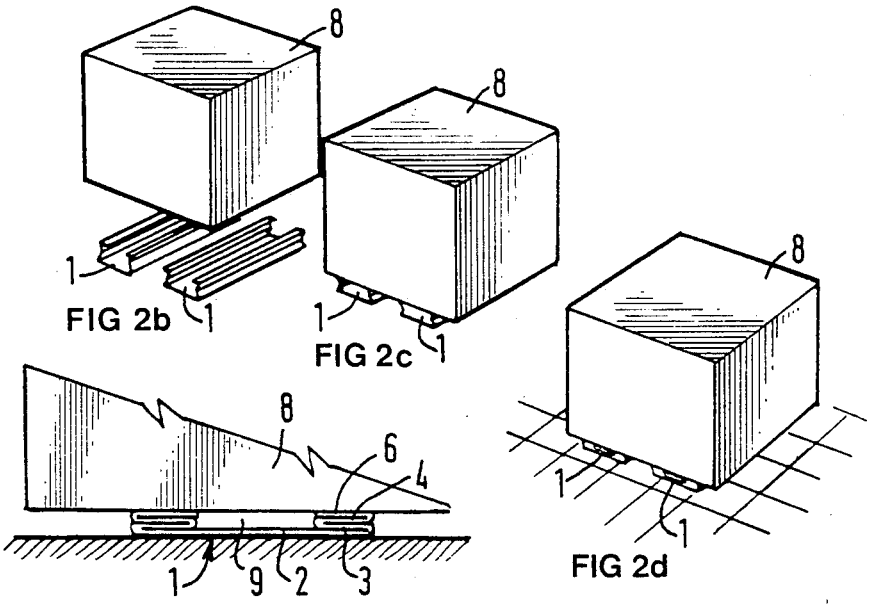
FIG 2b
FIG 2c
FIG 2d
FIG 2a

COLLAPSIBLE EXPANSIBLE HANDLING FACILITY FOR UNITIZED AND UNIT LOADS

This invention relates to apparatus used for the movement of unitised and unit loads and in particular to the preparation, loading, and unloading operations in the transport of loads.

PRIOR BACKGROUND ART

It is well known to facilitate the handling of unitised and unit loads by carrying them on a pallet.

Such pallets may be of steel, plastic, aluminium or composites of different materials such as fibreboard with plastic; but are mainly of timber, to provide the strength to support the load and as spaces suitable for use with mechanical handling equipment such as lift truck forks, pallet trucks, conveyors, and slings.

When these pallets are designed to provide the strength, quality, accuracy, dimension, shape and material best suited to the products, handling equipment, racking and procedures at a particular location, then such features are indispensable to the efficient operation of the handling system.

However, in designing for in-house functions features are used in the pallets which render them undesirable for use in transporting loads to other locations.

It is often the case that the pallet used in transit:

(a) Adds significantly to the dead weight of a shipment.

(b) Reduces the effective volume utilisation of the carrier vehicle.

(c) Adds to shipment cost per unit of product.

(d) Is of high cost to provide strength, quality, accuracy requirements.

(e) Needs replacements to maintain the pallet supply.

(f) Has to be returned.

(g) can get lost on return.

(h) May not be dimensionally compatible with transport vehicles and/or destination handling and storage systems.

(i) May be made of a material which is not compatible with a particular mixed transit load or legal requirement at destination. e.g. certain chemicals on an aluminium pallet or timber pallets not satisfying pest control requirements.

Practices within the existing art include:

Accepting the known inefficiencies, high costs and loss risk, but transporting goods on in-house pallets anyway.

Stripping loads from their pallets and loading by hand to vehicles and containers. This practice is very arduous both at desptach and receipt location; a disadvantage which is compounded by costs incurred due to time taken through poor labour utilisation and overdue turn around time of transportation units.

Use of one trip timber pallets. These are weaker, lighter and cheaper than 'normal' or special ones, but are still poor in space utilization and still incur weight and cost penalties, albeit reduced.

Use of composite pallets; such as fibreboard/plastic, fibreboard/polystyrene etc; which although effective in respect of lightness of weight and reduced cost, lose out on space utilisation and strength.

Use of slip sheets; which are excellent, where applicable, in space utilisation, costs and strength characteristics and are re-cycleable. However they can only be handled by lift trucks which are fitted with special purpose "push-pull" attachments.

This means that such attachments must be in use at all despatch and reception locations. They are expensive; they have the effect of reducing the turning circle of the truck; the attachment downrates the safe lifting load rating of the truck, which means larger and heavier trucks are needed than normally acceptable for given weights of loads; and they require significant operator training and skill.

Further, in stacks more than one load high, the slip sheet operation involves the load being handled skidding over the top of the one upon which it is resting, whilst the uninterrupted space between sheets and vertical loads is not acceptable for transport of perishable goods requiring through ventilation.

It has been proposed to form pallets from fibreboard material affording low cost and being discardable at the destination, and in addition collapsible pallets of such material have been proposed, see U.S. Pat. Nos. 2,702,682 and 3,167,038. In the latter patent the pallet is collapsed after use manually and similarly erected prior to use manually and the intention is to afford ready storage when out-of-use. The pallet is not adapted to open on entry of fork lifts and thereafter collapse. In the former patent a folded fibreboard material is used for the legs but this does not expand in use and forms merely a convenient construction for varying the height of the base during manufacture.

In British Pat. No. 696,214 a pallet is disclosed for four-way entry this having U-shape channels of metal which are not intended to collapse. None of the prior discloses or suggests a lightweight construction of pallet having the capability of supporting a heavy load but which nevertheless can also accept fork lift entry through an expansion action. All the aforementioned prior-art is concerned with maintaining at all times sufficient space for clean-entry of the forks of a fork-lift truck.

OBJECTS OF THE INVENTION

This invention is primarily intended to improve the efficiency of the transport of unitised and unit loads when used instead of existing pallets, pallet boxes or slip sheets.

Such efficiency improvement may be achieved in the invention by replacement of pallets through reduced dead weight, less cost, and space, quantity and quality control simplification, and ease of quickly adapting to dimensional and material requirement changes.

When the present invention is used to replace slip sheets, some extra unit cost is incurred, but significant advantages are gained as the loads can be handled by normal lift truck forks or slings and the loads can be lifted with a clean action so there is no skidding across the tops of supporting loads in stacks. Furthermore spaces are provided for a degree of ventilation between stacked loads.

SUMMARY OF THE INVENTION

Broadly according to this invention there is provided a unit or unitised load handling means comprising a sleeve secured to a lower surface of the load or to a support pallet to carry the load, the sleeve being defined by a base portion to form a ground bearing surface, side wall portions embodying longitudinal pleats and arranged to collapse or expand by folding about the pleats, and a top portion to secure the sleeves to the load or pallet, the sleeve when fully collapsed under load defining a space sufficient for initial entry of load handling equipment, the pleats allowing the sleeve to expand to fully receive the load handling equipment.

This invention further provides a pallet, baseboard, container or box to a surface of which is secured two sleeve means, in accordance with any preceding claim, in parallel spaced relationship.

As an alternative to the above there may be provided a pallet, baseboard, container or box to a surface of which is secured a sleeve means according to any preceding claim, and having a width extending across a substantial part of the width of the surface.

A preferred arrangement may have the pallet, baseboard, container or box in combination with a second pallet having a base forming a conventional pallet structure and a top including battens defining channels to receive the sleeves, with the battens supporting the lower surface of the pallet or like.

When the sleeve members, normally used in spaced pairs, lie beneath a unitised or unit load they will be in a collapsed state under the weight of the load thereon but there will be a space formed inside the length of each sleeve by virtue of the convolutions formed by the thicknesses of the folded sides under compression.

Placed at a suitable distance the sleeves provide the necessary entrance for suitable mechanical lifting equipment.

The structure according to the invention can be used as follows:

HANDLING WITH LIFT TRUCKS

The tips of lift truck forks, set apart at a distance to match the sleeves centres dimension, may enter the open ends of the formed spaces and as the forks are driven on under the load, the pleated sides of the sleeves open with the increasing thickness of the forks, thus maintaining the integrity of the sleeve construction and giving protection to the unit load above and also to the floor or deck or supporting load beneath, from fork scudding damage.

When the forks reach a suitable position under the load they may be raised to lift, transport and then place the unit to rest in or on a transport vehicle. The forks may then be withdrawn, allowing the sleeves to collapse and resume their open ended inner space, compressed sided state, for lift truck fork handling at the unit destination.

It is advantageous when handling loads in this manner to slightly tilt the forks forward during their entry and withdrawal movements within the sleeves and also to stop them short of passing completely through and clear of the far end of the load.

In this way the width of the load is used to pinch the rear of the sleeves downward against the floor, deck or load below, whilst the drag of the forks' underside is reduced. Frictional advantage may also be improved by fitting polished extension forks or with clean and polished normal forks; slip and non slip coatings on the sleeves; or a few creased ridges standing proud on the inside top and bottom sleeves faces.

Such procedures can help when unrestrained loads are handled on slippery surfaces and can overcome tendencies for such loads to shunt forward during fork entry and follow backwards during forks withdrawal. Alternatively, pick up and stripping may be carried out with the load restrained or on a slave pallet.

HANDLING WITH SLINGS

Although the availability of lift trucks with normal forks is common throughout the world, there are occasions where it is desirable to handle unitised and unit loads with 'top lift' slings, such as when stowing into the holds of deep sea vessels, reception of unitised loads at farms and construction sites and top lift, in plant, handling systems (cranes, travelling hoists).

For such requirements the sleeves of the invention may be spaced to suit slinging.

The sleeves may be constructed to suit chains, but in the case of non attached slings the flat, webbing slings of nylon or terylene such as that used for motor vehicle seat belts is suitable, the flat slings passing easily through the spaces within the sleeves and up to a lifting beam or crucifix for correct top lifting.

When the sleeves of the invention are assembled together with slinging loops and a base sheet or board, a one piece device can be provided for both top lift and bottom lift facilities for unitised or unit loads.

Normally a disposable facility, this sling provides all the advantages of the pallet when base handling movements and side or end loading to and unloading from transportation such as lorries, rail cars and containers, are undertaken.

Further, when top lifting facilities are essential, as in docks, quarries, construction sites, farms and certain industrial premises, the loads may not only be slung successfully but will provide the additional advantage of not requiring the fitting and removing of on site owned slings.

If the sling carried loads are base handled over the sides of lorry flats by lift trucks so that the sleeves lie on the decks, below and against the raised side risers, unloading at the destination in the reverse manner will normally be difficult.

When lorry flats are used to carry loads then battens can be used to keep the sleeve openings visible and accessible for forks at the receiving destination. The rivers may be castellated with the spaces matching the sleeve centres to provide access to the handling spaces.

Another advantage of slings is that in situations where the loads are not square they may be placed in orientation to suit the open topped space available.

As the invention is intended to be a transit facility the load may be sized so that it may be loaded and unloaded in one direction only.

It is possible to cut and fit sleeves to form a base which may be approached by handling equipment from any side to provide four way entry.

In its preferred use the invention is intended to be strong enough for the life of a particular load, prior, during and subsequent to a single transportation journey. (i.e. non-returnable).

The material of the construction will normally be fibreboard or similar paper based recycled board which may be creased in the flat to facilitate the folding or convolution of the pleated sides.

Alternatively where a multi trip, returnable handling facility is preferred, the material of construction may still be of fibreboard material but possibly of heavier construction or of other suitable material such as a thermo plastics such as polypropylene or polyethylene where the sleeves may be formed from flat sheets or extruded as open or closed channels with the pleats formed by the extrusion die.

Preferably from an ecological aspect the material used will be recycleable, disposable, or bio-degradeable.

The shape of the basic sleeve part of the invention is variable to suit the requirement of particular handling systems and the type of unitised or unit loads to be carried.

The sleeve may be of dimension, thickness of material, number of pleats and materials as appropriate to enable the cost and utility to be optimized.

PREFERRED EMBODIMENTS OF THE INVENTION

The invention is described further and illustrated with reference to the accompanying drawings showing various embodiments and configurations for use with certain loads.

Figure 4A:
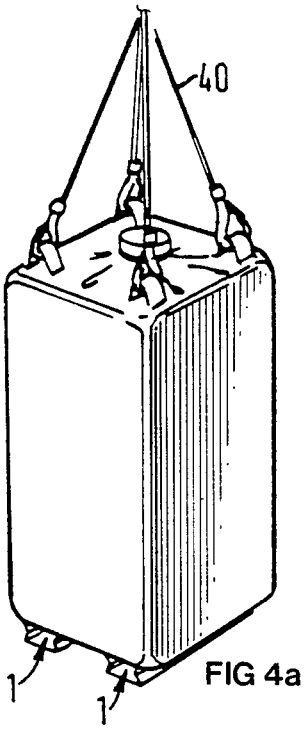
Figure 4:
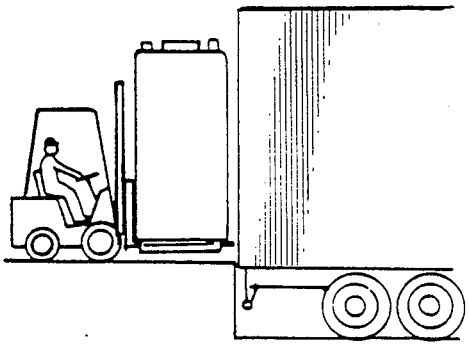
Figure 5:
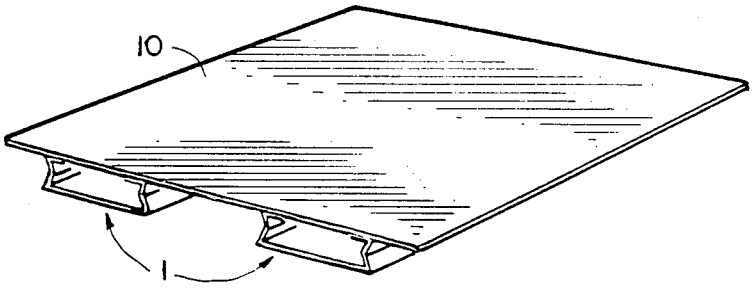
Figure 6:
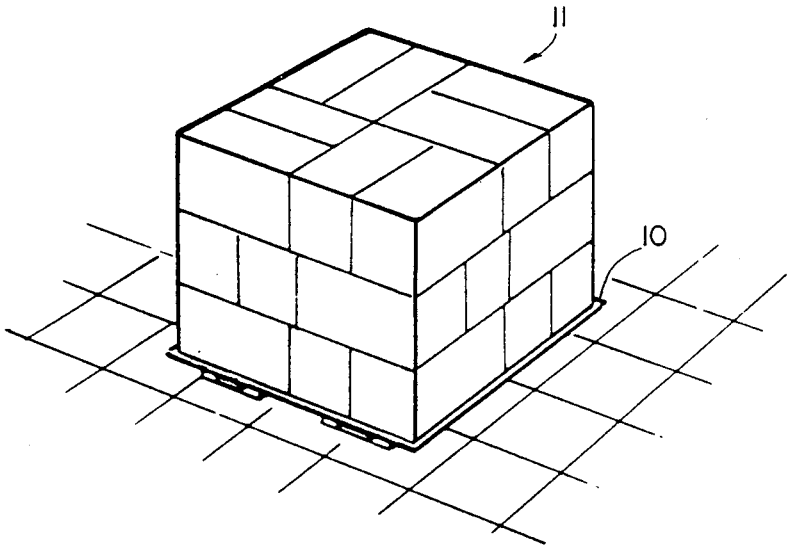
Figure 7:
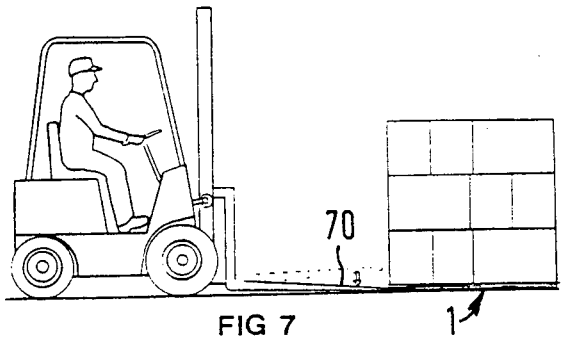
Figure 8:
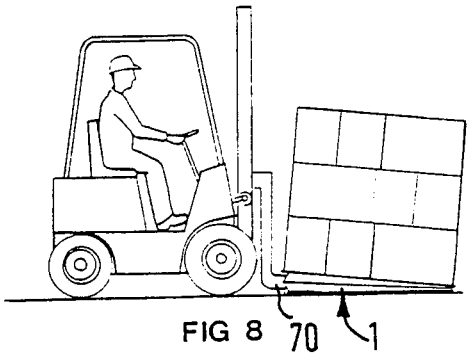
Figure 9:
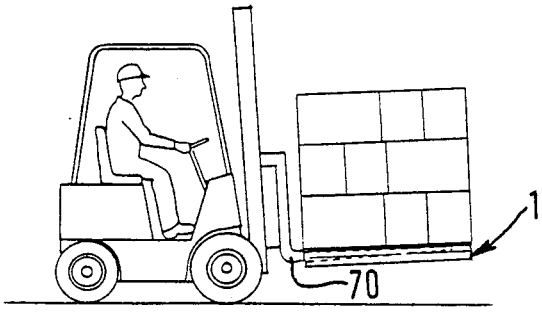
Figure 10:
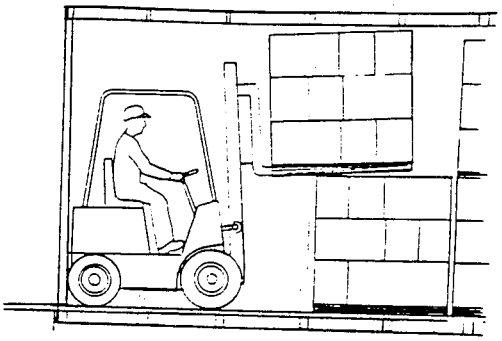
Figure 10A:
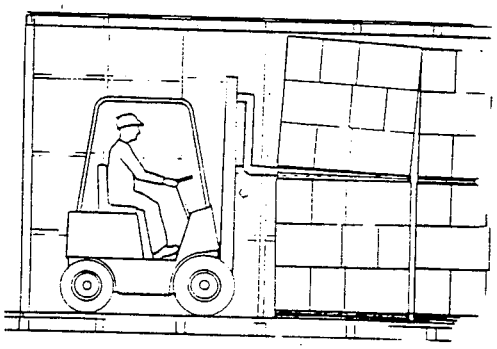
Figure 11:
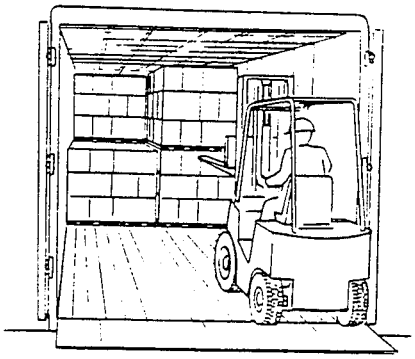
Figure 12:
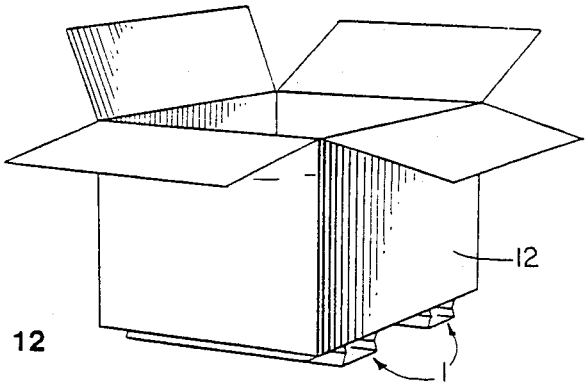
Figure 13A:
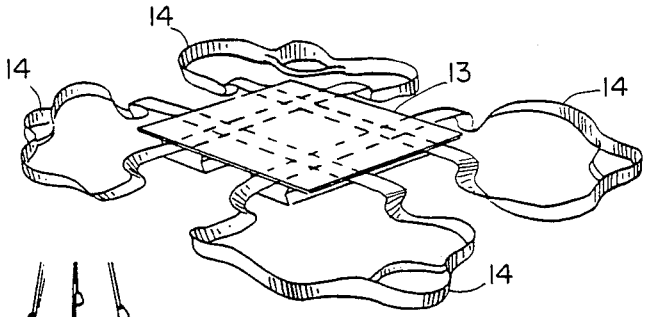
Figure 13B:
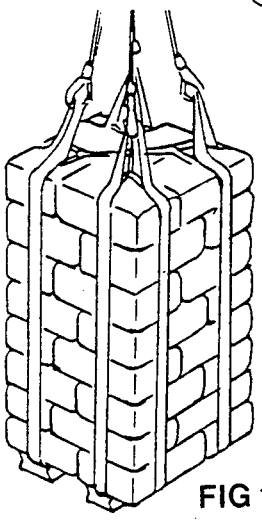
Figure 13C:
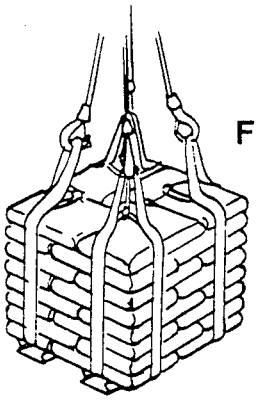
Figure 14A:
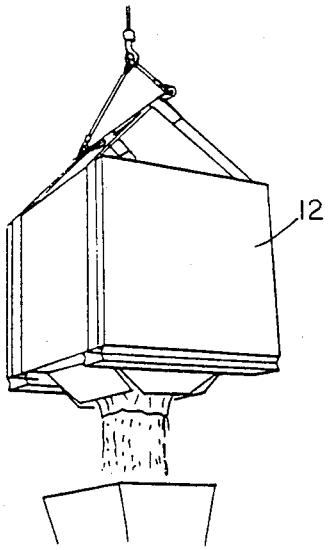
Figure 14B:
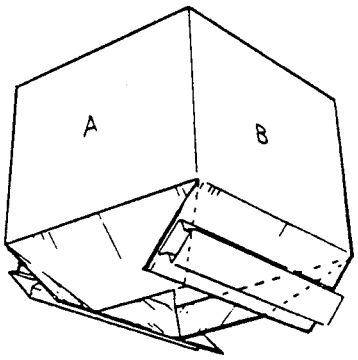
Figure 14C:
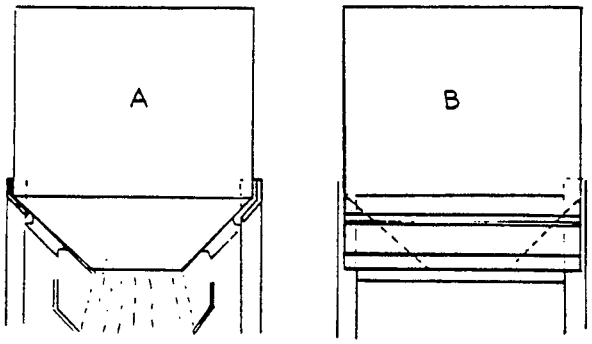
Figure 14D:
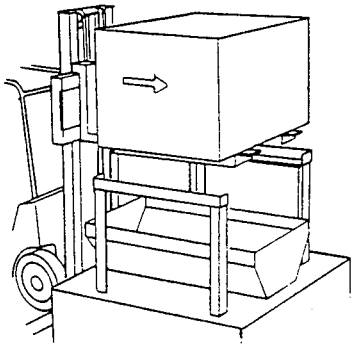
Figure 14E:
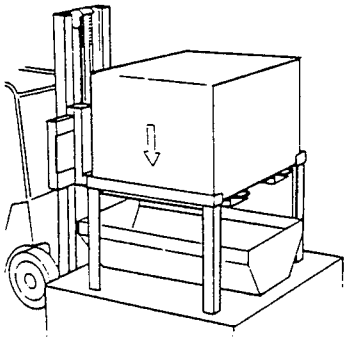
Figure 14F:
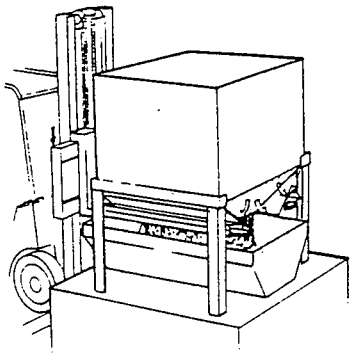
Figure 14G:
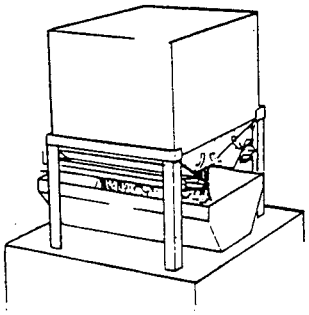
Figure 15A:
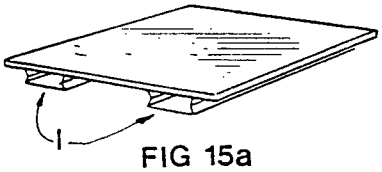
Figure 15B:
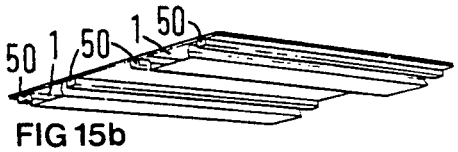
Figure 16:
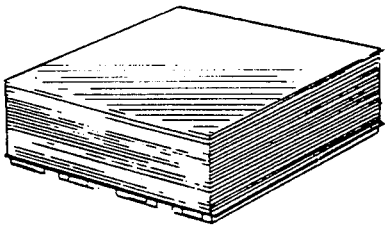
Figure 17:
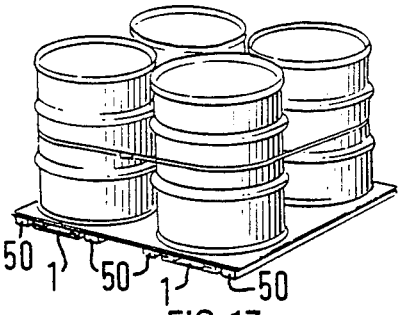
Figure 19C:
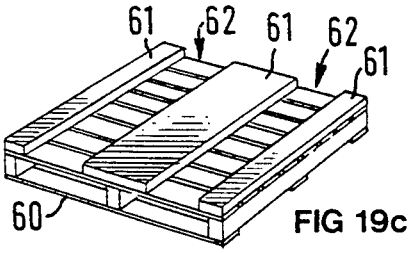
Figure 19B:
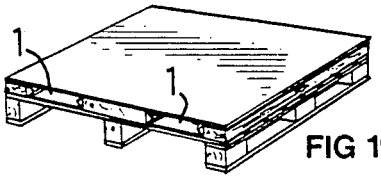
Figure 19A:
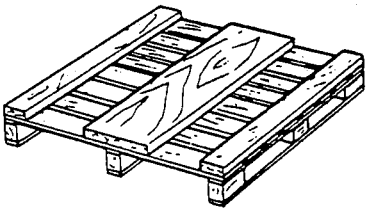
Figure 20:
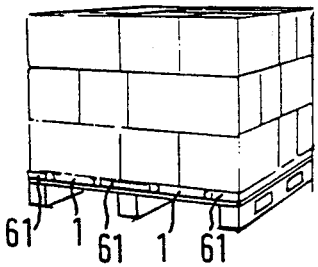
Figure 21:
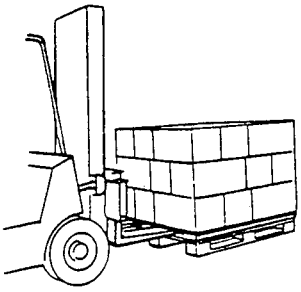
Figure 23:
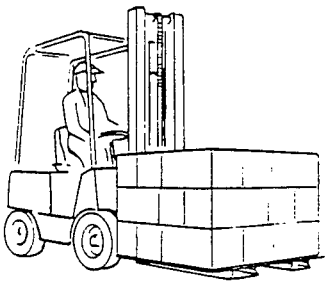
Figure 22:
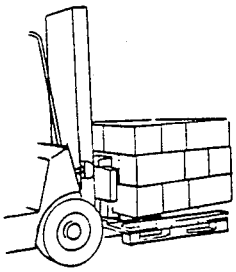
Figure 25:
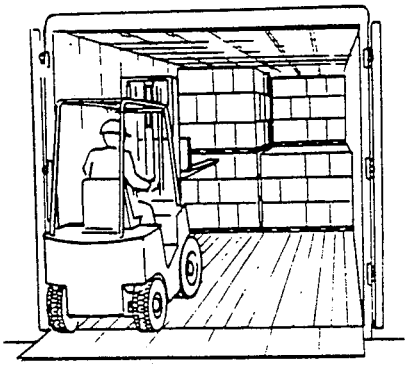
Figure 24:
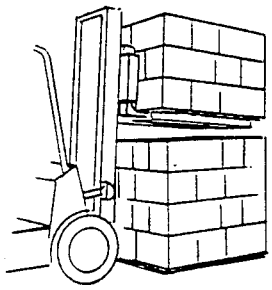

Referring to the drawings:

FIG. 1 shows the invention in the form of an open pleated sleeve which may be used to form a collapsible and expandable unitised or unit load handling facility, FIGS. 2*a* to 2*d* show how two such sleeves may be fixed to a load, FIG. 3 shows a sleeve similarly pleated to that in FIG. 1 but in this case one top pleat has been extended so that it may be fastened to its opposite top pleat to form a closed sleeve, FIGS. 4 and 4*a* show two closed sleeves in combination with a top lift intermediate bulk container to provide a bottom lift option for transportation and discharging in low headroom situations, FIG. 5 shows how two sleeves may be fastened to a top board to form a pallet and to maintain the selected dimension of sleeve centres distance, FIG. 6 shows a unitised load built on a pallet of FIG. 5 and at rest on a floor, FIG. 7 shows lift truck forks about to enter the sleeves of a pallet, FIG. 8 shows the truck forks having passed under the load to a position ready for lifting have caused the pleats to open, FIG. 9 shows the load raised on the forks in a transportable position, FIGS. 10 and 10*a* show the load being placed upon another load, then the forks being withdrawn, FIG. 11 shows the load at rest with the pleats resuming their collapsed state, FIG. 12 shows how two sleeves may be fitted to provide a handling facility for a one piece box, FIGS. 13*a* to 13*c* show a one piece sling arrangement for loads, FIGS. 14*a* to 14*g* show a box fitted with permanent or disposable slings and using the sleeves for locating the slings under the load, FIGS. 15*a* and 15*b* show two sleeves added to a top board of plywood or chipboard to satisfy a stiffness requirement, FIG. 16 shows the use of additional sleeves to provide a load levelling facility, FIG. 17 shows timber battens incorporated into a pallet to maintain fork spaces and to resist the action of heavy, sharp topped loads such as steel drums or bobbins, FIG. 19 shows a further arrangement for resisting heavy loads, FIGS. 19*a* to 19*c* show a secondary pallet for use with the pleated sleeve arrangement, FIG. 20 shows a unitised load on a primary pallet resting upon a secondary pallet, FIG. 21 shows lift truck forks approaching the primary pallet sleeves, FIG. 22 shows the forks having passed through the sleeves and in a lift position, FIG. 23 shows the load raised on the lift truck forks in a transportable position, FIG. 24 shows the load being placed upon another load, and FIG. 25 shows the load at rest in its transportable state with the sleeves collapsed and maintaining the necessary spaces.

Referring firstly to FIGS. 1 and 2*a*–2*d* of the drawings, these show a basic sleeve unit, two of which would conventionally be used with a load which may comprise a box or other container. As shown the sleeve 1 is generally of channel shape having a base 2 and side walls constituted by two sections 3 and 4 which are joined through an intermediate crease 5. The top section 4 of the side wall has an inturned flange part 6 which serves to secure the sleeve member to a container or the like. This flange 6 is similarly connected to the side wall member 4 by means of crease line 7. In FIG. 2*a* the sleeves are shown attached to a box like container 8 with the lateral spacing between two sleeves arranged to conform with the standard spacing between the forks of a fork lift truck (not shown). In the unloaded condition the sleeve will be in a partially extended relaxed state as shown in FIG. 1 and FIGS. 2*b* and *c*, but when placed on a floor the weight of the contents of box 8 will cause the sleeve to be compressed to adopt the form shown in FIG. 2*a* wherein the side wall portions 3 and 4 take up a convoluted collapsed state as illustrated. In this state however there is still left a sufficient space 9 between the lower part 2 of the channel and the lower part of the box 8 into which the tapered ends of the forks of a fork lift truck may engage. As will be appreciated from the drawings, with such an arrangement according to the invention the overall height of the box 8 is reduced to a minimum after the forks of a fork lift truck have been withdrawn.

The sleeve is conveniently constructed of a fibre board material and this can be constructed from a sheet by creasing and folding to the shape shown.

As may be also seen from FIG. 2*a*, when in the folded or collapsed state the sleeve forms a good load bearing support and notwithstanding the cardboard material used, may carry a considerable loading.

Referring now to FIG. 3, this shows a modified arrangement, the essential difference being the extension of one of the flanges 6 to overlie and be joined with the opposite flange 6 to form a closed box like sleeve. The construction is otherwise similar to that described. This arrangement may be used to support loads by attachment to the base and in FIG. 4*a* a container is shown having top supports for a sling assembly 40 as well as having the closed sleeves of FIG. 3 secured to the base. FIG. 4*a* shows the load being supported by a sling system, whereas FIG. 4 shows the load being transported by a fork lift into the rear end of a road vehicle.

FIGS. 5 and 6 show a further arrangement in which the sleeve units are secured to a base 10 forming a pallet which may be loaded with cartons 11 or the like.

FIGS. 7 to 9 show the action in lifting a load supported on the sleeves according to the invention, and in FIG. 7 the load, for example that indicated in FIG. 6, is shown with the sleeves in the collapsed state with the forks 70 about to enter the partially open portions of each sleeve. As can be seen, the forks 70 are tapered so that the ends may insert into the sleeves, and as the forks are driven home the sleeves expand about the crease lines 7 with the expansion progressing from the point of entry as indicated in FIG. 8.

After entry by sufficient distance to ensure adequate support for the load the forks may be raised to transport the load as indicated in FIG. 9. FIGS. 10 and 11 show the raised load being placed within a container for transport, and after having located the load correctly as in FIG. 10*a* the forks may be progressively withdrawn, during which action the sleeves collapse and the load is left in a stable state as shown in FIG. 11.

FIG. 12 shows an arrangement in which a cardboard container box 12 is integrally provided with the sleeves 1 to form a complete carton which can be lifted by means of a fork lift as previously described. FIGS. 13*a*–13*c* show an arrangement in which a base 13 is provided with the sleeves 1 to incorporate slings 14 attached thereto whereby a load of sacks or the like may be supported and selectively lifted either through the sling means or through the sleeves. The box unit of FIG. 12 may have the base constructed of timber or polystyrene for strength and such an arrangement is preferred for purposes of security and protection of the contents. The boxes are independently stackable without requiring separate pallets.

Such a box 12 may be adapted for discharge of the contents through the base and FIGS. 14*a*–14*g* show various methods by which this may be achieved. Where slings are used the base can be opened as indicated in FIG. 14*a* or where slings are not used the whole bottom construction including flaps carrying the sleeves may be allowed to fall open after withdrawal of the forks of a fork lift truck as exemplified in FIGS. 14*b* to 14*f*. As shown in FIGS. 14*g* and 14*f*, the base can be arranged to open whilst the forks of the fork lift remain in the sleeves, thereby providing a controlled discharge of the product.

In a modified arrangement additional material may be provided in the base of the boxes or extra sleeves 1 may be included. FIG. 15*a* shows two sleeves secured to a base of plywood suitable for supporting various articles, and in FIG. 16 a base is indicated having four such sleeves attached thereto and serving to support greater loadings through the larger surface provided on the underside.

FIG. 15*b* shows an arrangement wherein the sleeves 1 have at each side thereof longitudinally extending battens 50 which are arranged to take part of the weight of the load when the sleeves are collapsed. This arrangement is particularly suitable for heavy items or articles having relatively sharp edges such as drums of FIG. 17 and the battens 50 serve to provide a suitable bearing surface for any pallets loaded on top.

Figure 18:
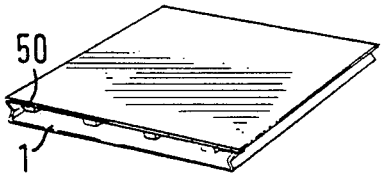

A further embodiment is shown in FIG. 18 wherein one sleeve 1 is shown extending across the width of the base with battens 50 located inside the sleeve to provide intermediate support when in the collapsed condition. When loads supported on the sleeves according to the invention are to be used in normal handling situations then a suitable standard pallet may be provided which has an upper surface provided with channels to receive the sleeves. Such an arrangement is indicated in FIGS. 19*a*–19*c* and 20 wherein a standard pallet unit 60 has battens 61 secured to the top surface to provide suitable channels 62 to receive the sleeves 1 of a pallet arrangement according to this invention. FIG. 19*b* shows a standard pallet and a pallet according to the invention assembled together, and FIG. 20 shows the arrangement with a load wherein the sleeves are collapsed with the battens 61 providing additional support for the load.

In FIG. 21 a fork lift truck is shown lifting a load from the standard pallet through entry of the forks into the sleeves according to the invention, and FIGS. 22 to 25 show the load which is now detached from the standard pallet being transported and stacked in a road vehicle in the manner described previously. At the destination the sequence of operations would of course be reversed to put the load onto a standard pallet for subsequent movement within the destination area.

As may be appreciated, the use of the pallet arrangement according to the invention in conjunction with standard pallets reduces wear and tear and hence prolongs the life whilst having the advantage of avoiding the standard pallet units having to be transported with the load between destinations.

I claim:

1. A unitised load handling means comprising a sleeve secured to a lower surface of the load, the sleeve being defined by a base to form a ground bearing surface, a pair of opposed side walls joined to the base and each including two side wall sections joined by a longitudinal crease, said sleeve arranged to collapse or expand by bending about the creases, an inturned part joined to the top of said side walls to secure the sleeve to the load, the sleeve when vertically expanded substantially defining an enlarged opening of rectangular cross-section therewithin and when fully collapsed under load defining an opening of rectangular cross-section therewithin of reduced height and of a width substantially different than when expanded and defining a space sufficient for initial entry of load handling equipment, said opening being laterally defined between said creases, and said creases allowing the sleeve to expand vertically to fully receive the load handling equipment.

2. A means in accordance with claim 1, wherein said creases are medially disposed along said side walls, the side walls folding inwardly of the sleeve about said creases.

3. A means in accordance with claim 2, wherein the side walls join integrally with the base, the junctions comprising crease lines.

4. A means in accordance with claim 3, wherein said inturned part comprises a flange integrally joined with each said side wall, the junction comprising a crease line.

5. A means in accordance with claim 4, wherein the sleeve when collapsed has the side wall sections, the base and flanges in coplanar stacked relationship forming a load bearing support foot.

6. A means in accordance with claim 1, wherein said inturned part extends the width of the sleeve, one side of said inturned part being integral with one side wall, the other side overlapping and joined to a a separate one said inturned part integral with the other side wall.

7. A means in accordance with claim 1, including two said sleeves, in parallel and spaced relationship.

8. A means in accordance with claim 7, in combination with a second load handling means having a base forming a conventional pallet structure and a top including battens defining channels to receive the sleeves, with the battens supporting the lower surface of the pallet structure.

9. A means according to claim 1, wherein said sleeve width extends across a substantial part of the width of the load lower surface.

10. A means in accordance with claim 9, including battens within the sleeves.

11. A unitised load handling means comprising two parallel spaced apart sleeves secured to a lower surface of the load, each said sleeve being defined by a base to form a ground bearing surface, a pair of opposed side walls joined to the base and each including two side wall sections joined by a longitudinal crease, said sleeve arranged to collapse or expand by bending about the creases, an inturned part joined to the top of said side walls to secure the sleeve to the load, the sleeves when fully collapsed under load defining a space sufficient for initial entry of load handling equipment, and said creases allowing the sleeves to expand to fully receive the load handling equipment, and battens extending parallel with said sleeves, the height of said battens being such as to provide ground bearing support for the load when the sleeves are collapsed.

* * * * *